United States Patent [19]

Ferreira et al.

[11] 4,174,085

[45] Nov. 13, 1979

[54] COLLAPSIBLE TRASH BAG HOLDER

[76] Inventors: Richard A. Ferreira; Albert Vincent, both of 82 Taunton Ave., East Providence, R.I. 02914

[21] Appl. No.: 973,881

[22] Filed: Dec. 26, 1978

[51] Int. Cl.[2] ..... A63B 55/04

[52] U.S. Cl. ..... 248/97; 108/11; 108/133; 248/99; 248/188.6

[58] Field of Search ..... 108/11, 12, 129, 133; 248/97-101, 188.6

[56] References Cited

U.S. PATENT DOCUMENTS

| | | | |
|---|---|---|---|
| D. 216,438 | 1/1970 | Gay et al. | 248/97 UX |
| 1,542,164 | 6/1925 | Nelson | 248/97 |
| 3,502,291 | 3/1970 | Ackerman et al. | 248/101 X |

*Primary Examiner*—James C. Mitchell
*Attorney, Agent, or Firm*—Salter & Michaelson

[57] ABSTRACT

A trash bag holder which moves from a generally planar collapsed storage position automatically to an open use position in which it can be used to support a flexible wall container such as a plastic trash bag. The device includes a substantially rigid rectangular frame from which elongated support elements outwardly extend at each corner thereof. The corners are each provided with a tapered socket to receive one end of such support elements which are, in turn, connected thereto by means of an extensible cord. The support elements may thus be moved to a collapsed position generally parallel to adjacent frame elements wherein the cords are under tension and when released, will automatically move to their extended open position for receipt of a trash bag.

12 Claims, 6 Drawing Figures

COLLAPSIBLE TRASH BAG HOLDER

BACKGROUND AND SUMMARY OF THE INVENTION

This invention relates to a device for supporting an open ended container, and particularly a trash bag holder. Such devices are generally known and include those having a permanent supporting stand and including an upper outwardly extending rim about which the upper edge of the container may be wrapped or curled and thus maintain the container in an open position. Such rim structure is upwardly spaced from the stand or platform which supports the device in an overall upright position. These devices have the disadvantage of being bulky and not adapted to occasional or seasonal use. Accordingly, attempts have been made to provide similar devices which are collapsible and thus may be stored when not in use. Such attempts, however, have generally involved overly complex constructions.

It is thus a primary object of the present invention to provide a trash bag holder of the above described type which is easily collapsible to a generally planar non-use storage position and yet which is not of an overly complex mechanical nature.

Another object of the present invention is the provision of a trash bag holder device of the type described which automatically moves from its non-use storage position into an open and self-supporting position.

A still further object of the present invention is the provision of a trash bag holder device of the previously indicated types which may further serve as a base for a table and the like.

These and other objects of the present invention are accomplished by a device including a substantially rigid generally rectangular frame having a plurality of elongated perimetal frame elements interconnected at the corners thereof. Each corner includes a connecting member having first and second frame element seat openings or bores disposed therein and orientated generally normal to each other. A third seat opening or bore is provided in each member and is angularly orientated with respect to and generally coplanar with the first seat opening. Elongated frame elements are adapted for positioning in the first and second seats while elongated support elements are disposed in the third seats. An elastically extensible cord is provided in each member and serves to resiliently maintain the support elements in their respective third seats. The support elements outwardly project from the plane of the frame in the use position of the device but they may be pulled outwardly against the bias of the elastic cord and swung to positions generally parallel to an adjacent frame element in the collapsed non-use storage position of the device. The extensible nature of the elastic cord permits the above described movement of the support elements between use and non-use positions and furthermore enables such support elements to automatically swing outwardly to a use position when released from their storage position.

Other objects, features and advantages of the invention shall become apparent as the description thereof proceeds when considered in connection with the accompanying illustrative drawing:

DESCRIPTION OF THE DRAWING

In the drawing which illustrates the best mode presently contemplated for carrying out the present invention.

DESCRIPTION OF THE INVENTION

Figure 1:
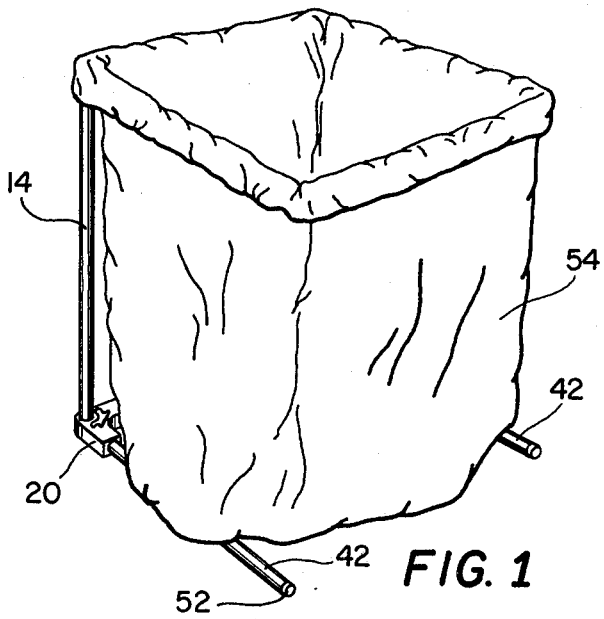
FIG. 1 is a perspective view showing the device of the present invention in an upright open use position with a trash bag supported thereby.

The trash bag holder device 10 of the present invention includes a generally rectangular rigid frame 12. The frame 12 includes a plurality of longitudinally extending generally tubular frame elements 14 arranged in a rectangular configuration and interconnected at the corners thereof by corner connecting members 16. The corner connecting members 16 include a central body portion 18 and a pair of arms 20 outwardly extending from the body and angularly disposed to one another with the overall configuration of such member somewhat L-shaped. The outer and inner surfaces 22, 24 respectively of such members are substantially flat or planar.

Figure 2:
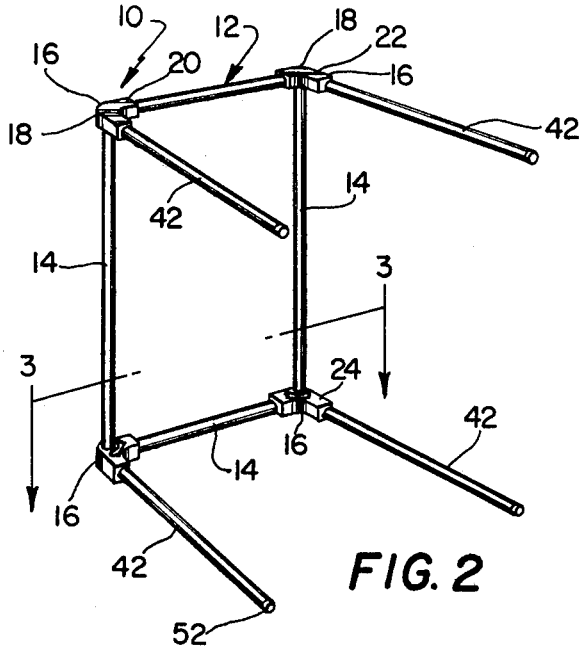
FIG. 2 is a perspective view of the device in its upright use position prior to receiving the trash bag.

The body 18 of each connecting member 16 is provided with a central cavity 26 which interconnects at one side with a first longitudinally orientated inwardly tapered generally conical bore 28 disposed in one of the arms 20 and opening at the exterior or terminal wall 30 thereof. Such bore or opening 28 forms a first seat for receipt of the conical head 32 of a plug 34 adapted for frictional fit within the open end of an opposed pair of frame elements 14. As shown in the drawing such opposed pair are the top and bottom frame elements 14 as shown in FIG. 2. A second longitudinally orientated bore or opening 36 is provided through the body 18 and disposed at an angle generally normal to that of the first bore 28. Such second bore 36 opens at the inner face 24 of each corner member 16 and thus forms a second seat. The bore or opening 36 need not pass entirely through the body 18. Opposite ends of that pair of frame elements 14 shown in vertical disposition in FIG. 2 are received in such openings 36 and accordingly complete the generally rigid construction of the frame 12.

The other arm 20 is provided with a bore or opening 38 through the front or terminal face 40 thereof. Such opening 38 is of inwardly tapered conical configuration, interconnects with the central cavity 26 and forms a third seat. Such third seat is adapted for receipt of a support element 42 of tubular configuration and provided at one end thereof with a headed plug member 44 similar in construction to the plug member 34. In that regard both plug members 34 and 44 are provided with an interior bore 46 passing entirely through the longitudinal extent thereof. Both plugs include an interior sleeve 48 which terminates at an inner shoulder or face 49. An elastomeric and accordingly extensible cord 50 passes through the bores 46 as well as central cavity 26. The cord includes knots 52 at opposite ends thereof which in turn engage the shoulders 49 and preferably place the cord under some tension. In this manner, then, the cord 50 serves to continually exert a pulling force upon the support elements 42 so as to continually urge them into engagement with the respective third seats formed by the tapered bores 38. The other end of each of the support elements 42 terminates in a free end 52.

Figure 4:
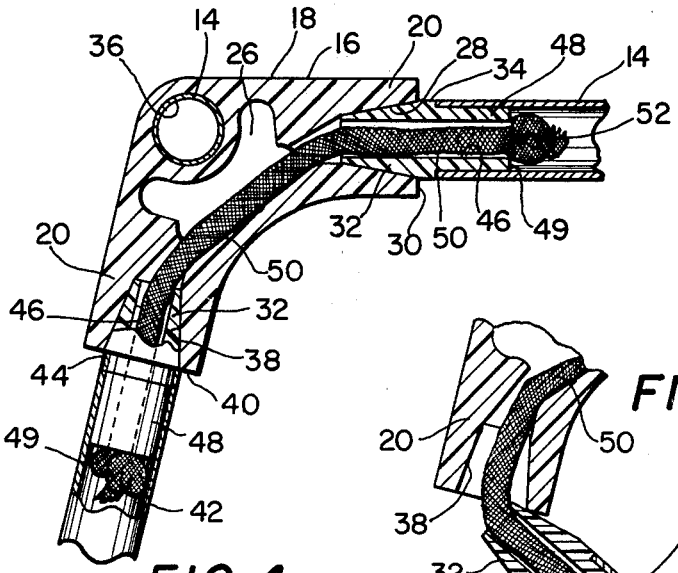
FIG. 4 is an enlarged fragmentary sectional view of one of the corner portions of the device and depicts one of the support elements in a fully seated outwardly extending use position.

In the open use position as shown in FIGS. 1, 2 & 4 of the drawing, the device 10 is adapted to be placed in an upright position, that is, with the frame 14 disposed vertically and with the lowermost pair of support elements 42 laterally spaced apart from each other resting on a supporting surface such as a floor or the like. In this regard, the flat outer surface 22 of the lowermost disposed corner connecting members 16 also serves to provide a stable base for supporting the device 10 in such upright position. The uppermost supporting elements 42 as well as the uppermost frame element 14 serve to interconnect such support elements and to form a somewhat U-shaped configuration to the upper portion of the device which is accordingly adapted for receipt of the curled or folded edge of a flexible wall bag such as a plastic trash container 54. In this manner, the bag 54 is supported in an open position such that it may receive trash through the open upper end thereof.

Figure 3:
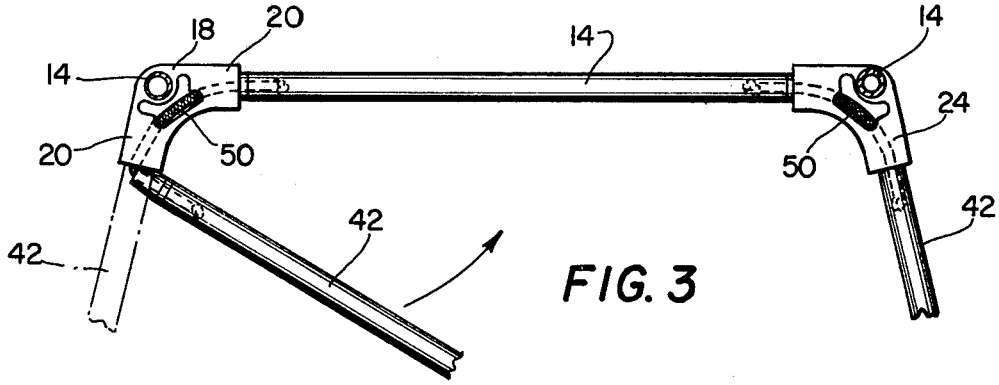
FIG. 3 is a fragmentary sectional view taken along the line 3—3 of FIG. 2 and illustrates the manner in which one of the supporting elements may be swung between open and storage positions.
Figure 5:
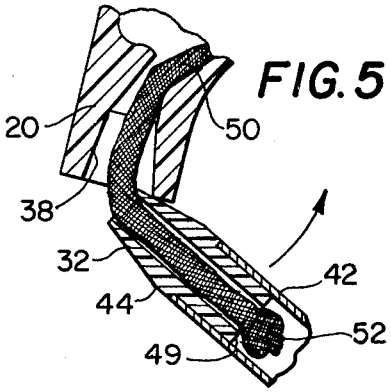
FIG. 5 is a view similar to FIG. 4 but showing the support element partially extended and inwardly swung towards a collapsed storage position.
Figure 6:
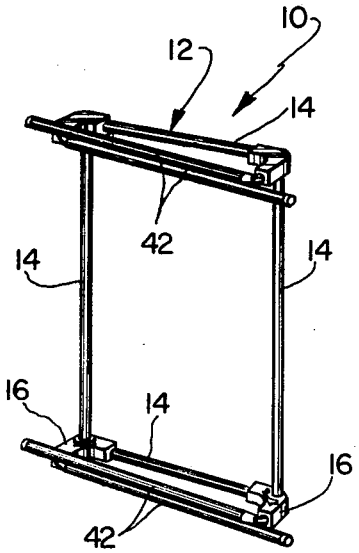
FIG. 6 is a perspective view of the device as shown in its collapsed storage position.

When it is desired to temporarily or permanently move or store the device, the support elements 42 thereof may be outwardly extended from the respective third seats to a position as best shown in FIGS. 3 and 5 of the drawing and hence to a fully collapsed position adjacent one of the frame elements 14. Such action is permitted by the extensible nature of the elastic cord 50. In the storage position, the support elements 42 may be temporarily taped or otherwise fastened against an adjacent frame element 14 so as to hold them in position and in this regard it is convenient that the upper and lower support elements 42 be swung inwardly towards each other so as to lie in substantially parallel pairs at the upper and lower ends of the frame 12 as shown in FIG. 6 so as to reduce the number of attachment points needed between the frame and elements 42. The manner of attachment may be as simple as providing a turn of adhesive tape or the like and when such tape or other attachment means is removed, the support elements 42 automatically swung outwardly away from each other to their open use position wherein the inner ends thereof are seated in their respective third seats by reason of the continual retraction force exerted thereon by the elastic cord 50.

Each of the frame and support elements 14 and 42 respectively are preferably formed from a lightweight metallic material such as aluminum and of tubular form. It is also not necessary that the elastic cord 50 extend inwardly to the frame elements 14, that is, that end of the cord 50 shown disposed within the frame members 14 may alternatively be attached or housed within the body of the corner member 16. Similarly, while it is desirable that the third seats formed by the bores 38 be inwardly tapered and of general conical construction so as to facilitate inward and outward movement of the similarly shaped head of the plug 44, other seat configurations are possible including a tapered extending outwardly from surface 40 and adapted to mate with an inwardly extending tapered bore other seat configurations are possible including a tapered head extending outwardly from surface 40 and adapted to mate with an inwardly extending tapered bore provided within the support elements 42.

The connection between the elements 14 and 42 and their respective plugs 34, 44 respectively is a secure press-fit connection while likewise the mounting of the heads 32 in their bores 28 is a secure press-fit connection, since once assembled, the frame elements 14 should not be readily removable from the corner members 16.

It will thus be seen that the device 10 is extremely light weight and hence may be easily transported, whether in its collapsed or open position. Since the bottom of bag 54 actually rests on the ground or floor, the upper support elements do not have to bear the weight of refuse within the bag, thus minimizing the weight and strength requirements of the device, although the tubular aluminum construction of the elements 14 and 42, and the preferred molded plastic construction of the corner members 16 result in a highly durable assembly. Although it has been found that the bag 54 may be effectively mounted on the holder 10 simply by folding the upper edges of the bag over the upper elements 14 and 42, as shown in FIG. 1, it will be understood that if a more secure attachment is deemed desirable, any suitable resilient clips may be used.

The device of the present invention may also be utilized as a table support and, in this regard, is adapted to rest upon the four terminal edges 52 of the support elements 42 while using the upper surfaces of the frame 12 as a support. When so utilized, it is desirable that the bores 28 and 38 which respectively form the first and third seats be coplanar and additionally at an angular relationship to each other approximating 90°. In this manner a higher degree of rigidity or strength is imparted to the device when utilized as a table type support. A particular angular relationship which has been found desirable is 100° inasmuch as such strikes a compromise between the rigidity needed when the device is utilized as a table and the preferable outward flare of the supporting elements 42 to enhance both the upright stability of the device when used as a trash bag holder but further to insure a greater spread or lateral extent of the open end of the trash bag 54 so received thereby.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A trash bag holder device comprising a substantially rigid generally rectangular frame having a plurality of elongated perimetal frame elements interconnected at the corners of said frame, each of said corners including a connecting member having a body, upper and lower pairs of spaced elongated support elements connected to said connecting members and outwardly projecting in a generally normal attitude from the plane of said frame and each of said support elements terminating in a free end, the lower pair of said support elements and that frame element disposed therebetween adapted to contact a supporting surface so as to support said device in a use position with said frame disposed upright, the upper pair of said support elements and that frame element disposed therebetween adapted to support the folded upper peripheral edge of a flexible wall container such as a plastic trash bag so as to hold such bag in an open receiving position, said body including means for permitting said support elements to be moved to a storage position substantially coplanar with an adjacent frame element.

2. The device of claim 1, including means for continually urging said support elements to their normal outwardly disposed use position.

3. The device of claim 2, said urging means including an elastic cord operationally connected to said body at one end and to said support element at the other end thereof.

4. The device of claim 3, said body including a bore inwardly projecting from opposed end faces thereof so as to form a seats for one of said frame elements and one of said support elements, both said support and said frame elements being tubular, said elastic cord connected at one end thereof to interior portions of that frame element disposed in one of said seats and connected at the other end thereof to interior portions of said support element.

5. The device of claim 1, each said connecting member body having at least one substantially flat surface, wherein the substantially flat surfaces of those connecting members disposed lowermost in said use position are adapted to contact said supporting surface so as to aid in the support of said device.

6. The device of claim 1, said connecting members each having a pair of coplanar arms angularly offset from said body, seats for one of said frame elements and for one of said support elements disposed in the free end faces of said arms.

7. The device of claim 1, including first and second longitudinally orientated frame element seats disposed in each said body, said first and second seats generally disposed normal to each other, a third longitudinally orientated seat in each said body angularly disposed in regard to and generally coplanar with said first seat and an elongated support element having one end disposed in each said third seat wherein said support elements each project outwardly in the same direction from said frame and terminate in a free end.

8. The device of claim 7, at least said third seats each being a recessed open ended bore disposed in said body.

9. The device of claim 8, said third seat bores being inwardly conically tapered and adapted to receive the similarly tapered one end of its respective support element.

10. The device of claim 7, said holding means including an elastic cord operationally connected to said body at one end and to said support element one end at the other end thereof.

11. The device of claim 10, both said support and said frame elements being tubular, said holding means including an elastic cord connected at one end thereof to interior portions of that frame element disposed in said first seat and connected at the other end thereof to interior portions of said support element.

12. The device of claim 7, said first and third seats each being an inwardly tapered conical recess, said frame and support elements portions disposed adjacent said first and third seats being of open ended tubular construction and having a plug disposed in said hollow ends, said plug having a conical outer end adapted for receipt in its respective conical recess in said upright use position of said device, said plugs having a central opening therethrough, a said holding means including an elastic cord passing through said plug openings and connected to said plugs at the inner ends thereof.

* * * * *